US005911528A

United States Patent [19]

Song

[11] Patent Number: 5,911,528

[45] Date of Patent: Jun. 15, 1999

[54] APPARATUS AND METHOD FOR CONTROLLING RIBBON MOTOR FOR COLOR PRINTING BASED ON TIME NOT USED FOLLOWING PRINTING

[75] Inventor: Jun-Pil Song, Suwon-city, Rep. of Korea

[73] Assignee: Samsung Electronics Co., Ltd., Kyungki-Do, Rep. of Korea

[21] Appl. No.: 08/788,918

[22] Filed: Jan. 22, 1997

[30] Foreign Application Priority Data

Jan. 22, 1996 [KR] Rep. of Korea ..... 96-1270

[51] Int. Cl.[6] ..... B41J 31/14

[52] U.S. Cl. ..... 400/223; 400/244

[58] Field of Search ..... 400/244, 223, 400/225, 218, 120.01, 120.02, 120.14, 202.4, 197, 208, 230, 231, 235; 347/213, 214, 215, 217

[56] References Cited

U.S. PATENT DOCUMENTS

| | | | |
|---|---|---|---|
| 193,642 | 7/1877 | Deming | 400/197 |
| 3,974,540 | 8/1976 | Bonner | 400/197 |
| 4,088,800 | 5/1978 | Nicholson | 400/197 |
| 4,213,419 | 7/1980 | Nicholson | 400/202.4 |
| 4,530,612 | 7/1985 | Butera et al. | 400/232 |
| 5,059,044 | 10/1991 | Takaishi | 400/120.14 |
| 5,269,612 | 12/1993 | Shimoha et al. | 400/207 |
| 5,651,620 | 7/1997 | Paranjpe | 400/120.02 |

FOREIGN PATENT DOCUMENTS

| | | | |
|---|---|---|---|
| 0271282 | 10/1989 | Japan | 400/230 |
| 40-6255146 | 9/1994 | Japan | 400/230 |
| 951297 | 3/1964 | United Kingdom | 400/230 |

OTHER PUBLICATIONS

Translation of Japanese Patent Application No. 01–271282 Published Oct. 30, 1989.

Translation of Japanese Patent Pat No. 6255146A (yorita) Sep. 1994.

*Primary Examiner*—Eugene Eickholt

*Attorney, Agent, or Firm*—Sughrue, Mion, Zinn, Macpeak & Seas, PLLC

[57] ABSTRACT

A method of controlling the operation of a ribbon motor for a color printing system, including the stop of rotating a ribbon in reverse by one color pitch so as to prevent the deterioration of print quality due to dust particulates on a surface of the ribbon after the completion of the printing operation. The above method further includes the steps of counting the time that the printing system is in a standby mode after the printing operation; and presetting a critical point in the printing system in order to compare the time that the printing system is in the standby mode with the critical point.

20 Claims, 5 Drawing Sheets

APPARATUS AND METHOD FOR CONTROLLING RIBBON MOTOR FOR COLOR PRINTING BASED ON TIME NOT USED FOLLOWING PRINTING

BACKGROUND OF THE INVENTION

The present invention relates generally to a method of controlling a ribbon motor for a color printing system. More particularly, it relates to a method of controlling the operation of a ribbon motor for a color printing system whereby a ribbon travels in reverse by one color pitch when the time that the printer is in a standby mode exceeds a prescribed critical time after the last printing operation so that the ribbon's region used for the next printing is free from dust.

A ribbon driving control portion of a conventional sublimation-type thermal printing system may be divided into four blocks: a color detector 106; a central processing unit CPU 107; a ribbon motor driving controller 108; and a ribbon motor 109, as shown in FIG. 1.

Once the printing operation starts, the CPU 107 controls the ribbon motor driving controller 108 to make a ribbon 102 travel until the color detector 106 detects yellow. When the color detector 106 detects yellow, a thermal print head 103 (TPH) is pressed onto the ribbon 102 and paper 101 and generates heat to output a corresponding image on the paper 101.

Once the "yellow" printing operation is completed, the CPU 107 returns the TPH 103 to its original position, and makes the ribbon 102 travel until the color detector 106 detects the next color, magenta. When the color detector 106 detects magenta, the TPH 103 is pressed onto the ribbon 102 and paper 101 to imprint data corresponding to the color on the paper 101. The above-described process is executed with respect to the printing of data corresponding to the colors of yellow, magenta, cyan and black.

FIG. 2 illustrates a ribbon used for a sublimation-type printing system. If three- or four-color printing operation is performed, the conventional ribbon motor driving controller 108 holds the ribbon ready until there is a command to print. If a long period of time elapses after printing, dust particles may lay on the surface of the ribbon, and when the printing operation is reinitiated, the dust on the ribbon is transferred to paper along with the color from the ribbon, thereby reducing the print quality.

As shown in FIG. 3, after the printing operation (in the case of the three- or four-color ribbon), the end of the ribbon's cyan/black section (the last printing color) is placed right under the TPH 103, and the dust adversely affects a region A of the ribbon so that dust particulates on the ribbon's yellow section negatively affect a region B of the ribbon during subsequent printing to thereby deteriorate the print quality. As described above, in such a sublimation-type thermal printing system, the dust on the ribbon and paper surface may deteriorate the print quality, and it is necessary to avoid the waste of ribbons and paper due to poor print quality by providing higher standards of print quality, reliability, and performance. As a long period of time elapses after printing, dust may lay on the surface of the ribbon and cause this poor print quality.

SUMMARY OF THE INVENTION

The present invention is directed to a method of controlling a ribbon motor for a color printing system which substantially obviates the above-described problem.

It is an object of the present invention to provide a method of controlling the operation of a ribbon motor whereby a ribbon travels in reverse by one color pitch when the printer has been in a standby mode for longer than a predetermined critical time after the last printing operation so that the ribbon's region used for the next printing is free from dust, and the deterioration of print quality is prevented.

It is another object of the present invention to provide a method of preventing the deterioration of print quality due to dust particulates laying on a ribbon in an idle thermal printing system, to thereby avoid waste of ribbons and paper.

In order to realize the above objects, the present invention provides a method of controlling the operation of a ribbon motor for a color printing system, including the step of rotating a ribbon in reverse so as to prevent the deterioration of print quality due to dust particulates on a surface of the ribbon after the completion of the printing operation. The above method also includes the steps of counting the time that the printing system is in a standby mode after the completion of the printing operation; and presetting a critical point in the printing system in order to compare the standby mode time with the critical point.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT

Reference will now be made in detail to the preferred embodiment of the present invention, examples of which are illustrated in the accompanying drawings.

Figure 1:
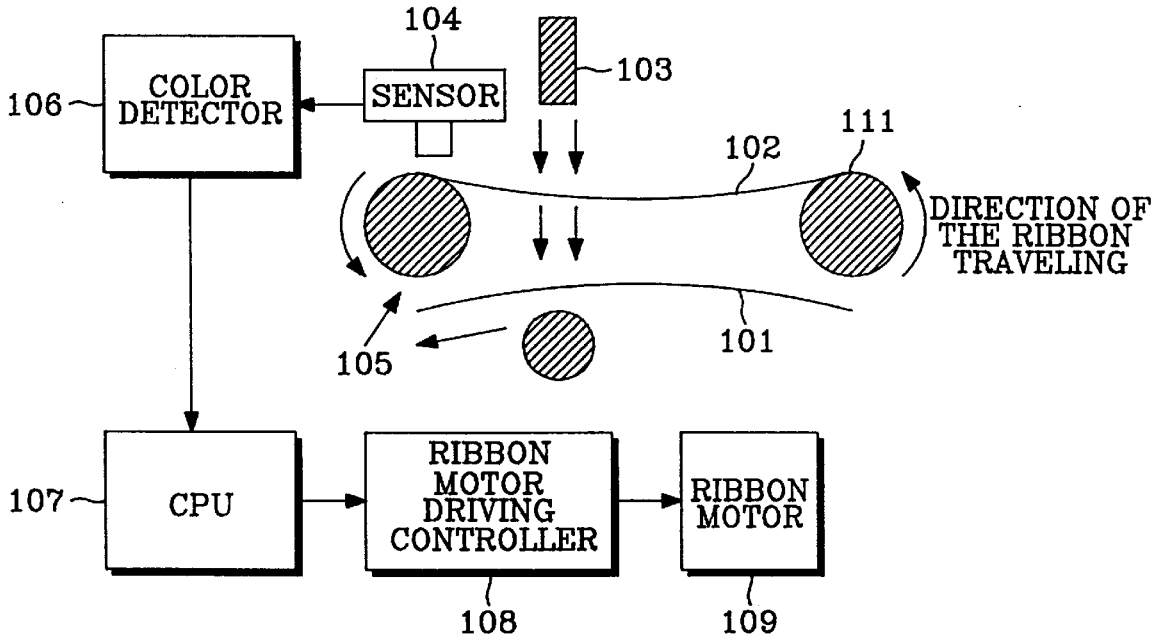
FIG. 1 is a block diagram of a conventional ribbon driving control portion.
Figure 2:
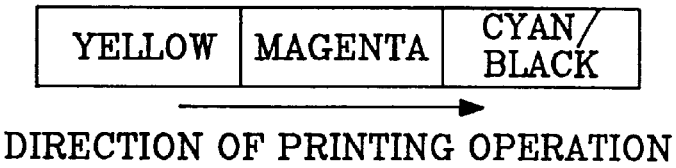
(PRIOR ART) Fig. 2
FIG. 2 illustrates a ribbon used for a sublimation-type printing system.
Figure 3:
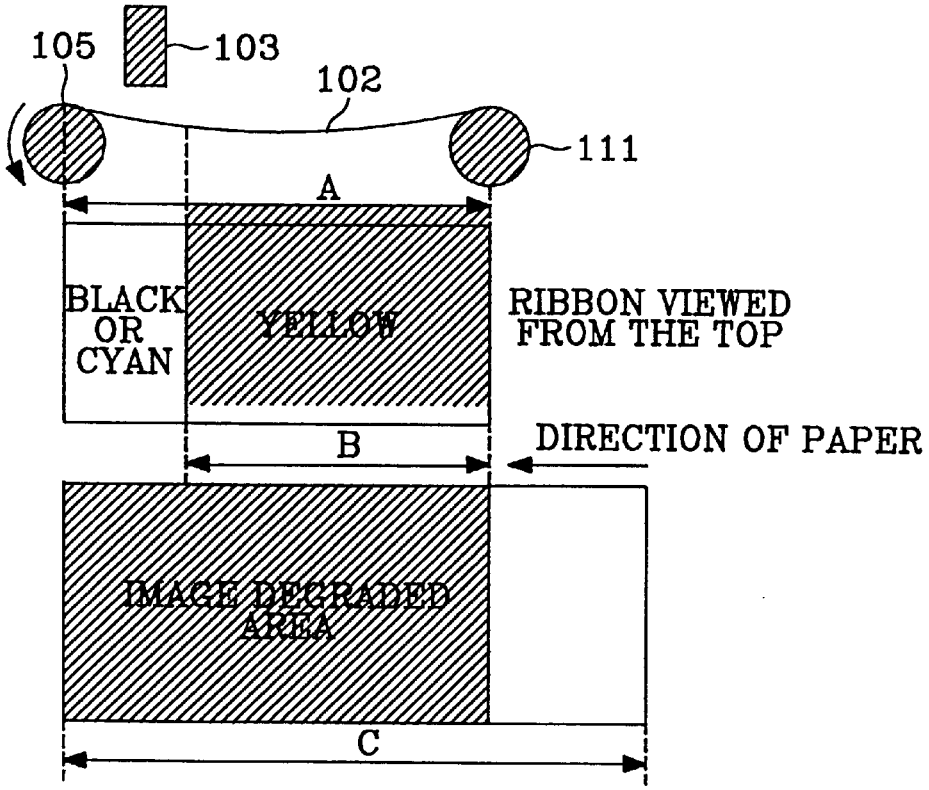
FIG. 3 shows a region of the ribbon where image degradation is created by dust on the ribbon surface.
Figure 4:
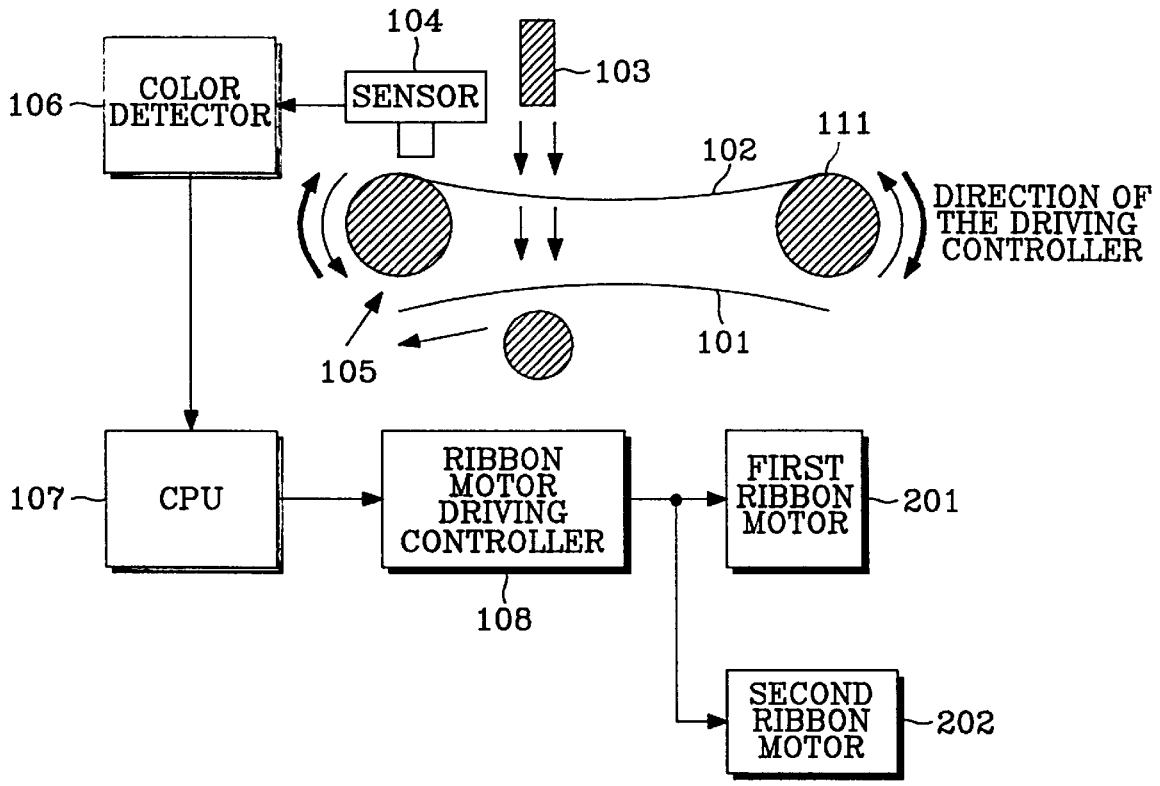
FIG. 4 is a block diagram of a ribbon driving control portion in accordance with the present invention.

FIG. 4 is a block diagram of the inventive ribbon driving control portion of a thermal printing system. As shown in FIG. 4, contrary to the conventional art, the present invention employs first and second ribbon motors 201 and 202 and a predetermined control program of a central processing unit 107.

Once the first ribbon motor 201 starts operating, a first reel 105 turns to rotate a ribbon forward, and when the second ribbon motor 202 operates, a second reel 111 turns to rotate the ribbon in reverse. The direction of the respective forward and reverse rotations is determined as shown in the drawings.

Figure 5:
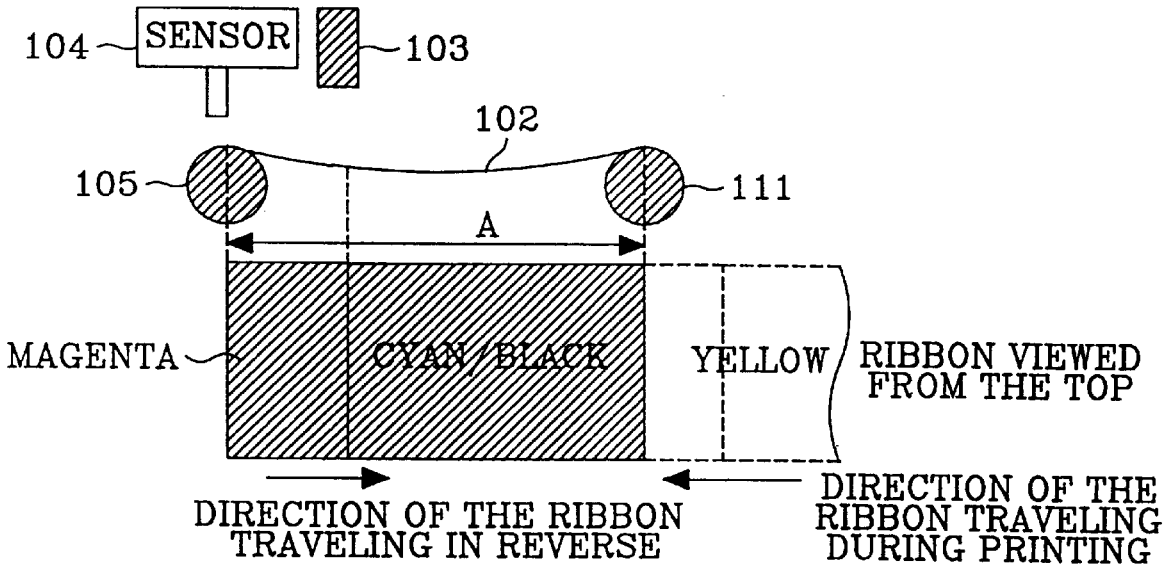
FIG. 5 shows the position of the ribbon that has rotated in reverse by one color pitch in accordance with the present invention.
Figure 6:
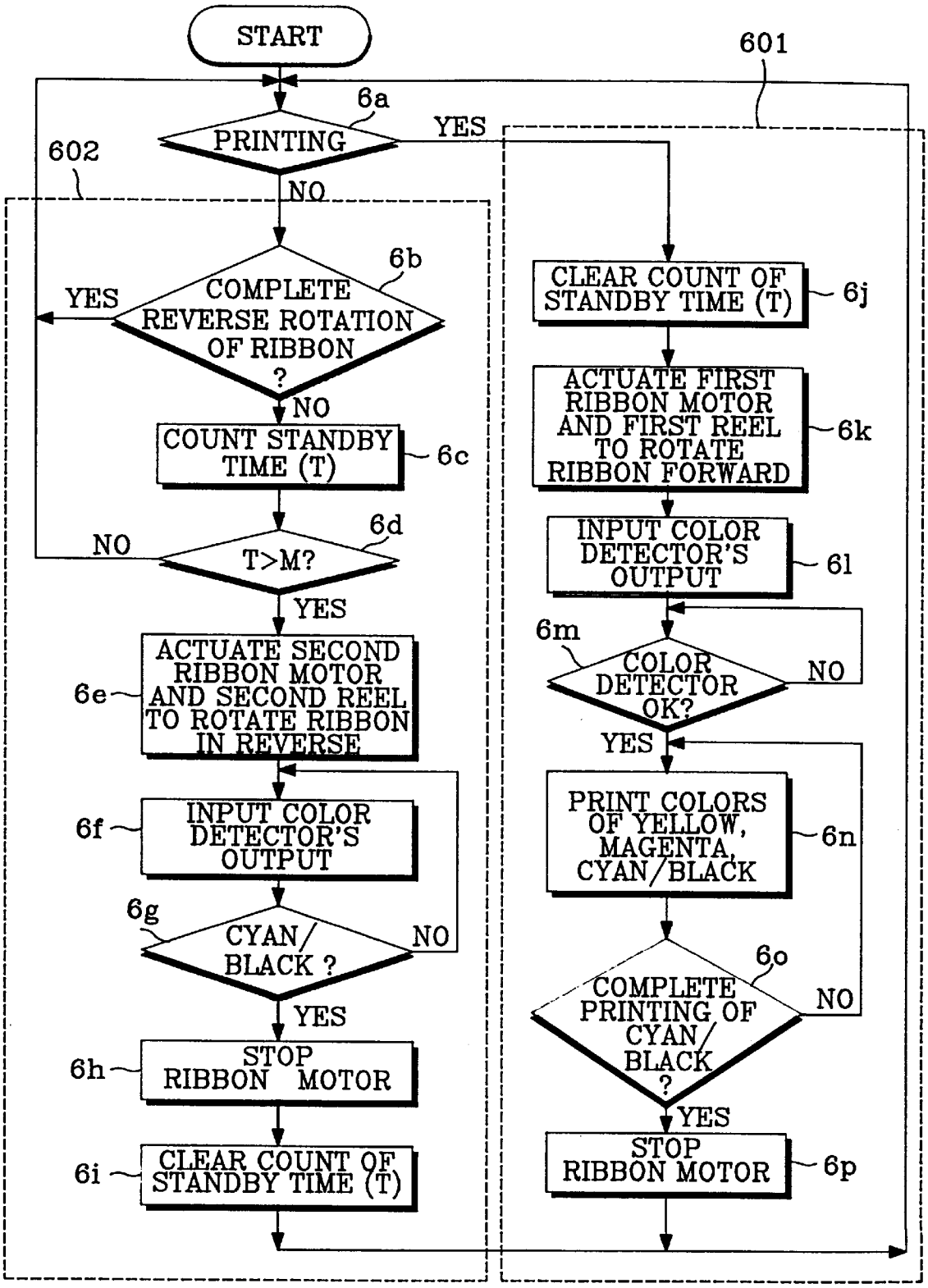
FIG. 6 is a flow chart of the control sequence of a ribbon driving cycle in accordance with the present invention.

FIG. 5 shows the position of the ribbon that has rotated in reverse in accordance with the present invention, and FIG. 6 is a flow chart of the control sequence of a ribbon driving cycle in accordance with the present invention.

The flow chart of FIG. 6 is divided into two parts: Step 602 of carrying out the printing operation of a three- or four-color ribbon with respect to the colors of yellow, magenta, and cyan/black when a command to start printing is input to the system; and Step 601 of rotating the ribbon in reverse by one color pitch if the time that the printing system is in standby mode exceeds a critical point.

The first preferred embodiment of the present invention will now be described in detail with reference to FIGS. 4, 5 and 6.

Referring first to FIG. 4, the first ribbon motor 201 operates the first reel 105 to rotate the ribbon in the direction which is the same as that of the printing operation (forward rotation), and the second ribbon motor 202 actuates the second reel 111 to rotate the ribbon in the direction opposite to that of the forward rotation.

FIG. 5 shows the position of the ribbon that has rotated in reverse by one color pitch in accordance with the present invention. The cyan or black part of the ribbon whose color has been transferred to paper during the preceding printing operation is shown, and the yellow part used for the next printing is wound around a ribbon cartridge 111. Accordingly, even if the dust lays on the ribbon surface, it adversely affects the cyan or black part of the ribbon, not the yellow part at all.

Turning to FIG. 6, the ribbon motor driving control program of the present invention will now be described. The flow chart of FIG. 6 may be divided into two parts: Step 601 of counting the time of the printing system being in standby mode and rotating the ribbon in reverse; and Step 602 of performing the printing operation when a command to print is input.

When the printing system is in printing mode at Step 6*a*, the CPU 107 counts (Step 602) the time of the system being in standby mode (standby time) before it starts printing. Before counting, the CPU 107 checks (Step 6*b*) if the ribbon has previously rotated in reverse. When the ribbon has already rotated in reverse, there is no need to count the standby time, and the CPU 107 returns to the first stage to check if there is a command to print.

On the contrary, if the ribbon has not yet rotated in reverse, the CPU 107 goes on counting the standby time. When there is a command to print during the CPU's counting, the CPU 107 clears the count of the standby time. If the count of the standby time exceeds a critical point M at Step 6*d*, the CPU 107 actuates (Step 6*e*) the second ribbon motor 202 to rotate the second reel 111 in reverse. Simultaneously the CPU 107 checks (Step 6*f*) the output of a color detector 106. When an output representing the cyan/black part of the three- or four-color ribbon is input at Step 6*g*, the CPU 107 stops the second ribbon motor 202 to thereby stop the reverse rotation of the ribbon at Step 6*h*.

As shown in FIG. 5, the front end of the cyan/black part of the ribbon is placed on the color detector 106. Accordingly, even if dust particulates lay on that part, they do not negatively affect the yellow part of the ribbon so that good print quality can be achieved during the next printing operation. The CPU 107 clears (Step 6*i*) the count of the standby time T after stopping the ribbon, and returns to the first stage to repeat the above procedure until a command to print is input.

When a command to print is input to the system, the printing system operates at Step 6*a*. The CPU 107 clears (6*j*) a count of the standby time T, and performs the three- or four-color printing operation. What is important at this stage is that the CPU 107 operates (Step 6*k*) the first ribbon motor 201 to turn the first reel 105 so that the ribbon rotates forward and the second reel motor 202 operates, contrary to the reverse rotation of the ribbon at Step 6*e*. Once the printing operation with respect to the last color is completed, the CPU 107 returns to the first stage and repeats the above procedures, waiting for a command to print.

The critical point M of Step 6*d* may be set at the factory and/or set/reset by a user/technician, for example, a sixty-minute critical point M may be employed, but any time may be used, as long as the objects and advantages of the invention are considered. For example, the smaller the critical point is, the less the dust wall accumulates on the yellow part of the ribbon. The trade off lies in that smaller critical points require more overhead operation of the motors, etc.

Therefore, if the standby time of the printing system exceeds a critical point after the last printing operation, the present invention makes the ribbon rotate in reverse by one color pitch to prevent the dust from accumulating on a region of the ribbon used for the next printing. In other words, when the yellow part of the ribbon to be used for the next printing is exposed to the dust particulates, the print quality may be deteriorated due to dust accumulation. Thus, the present invention allows the ribbon to rotate in reverse toward the cyan/black part that has been already used during the previous printing operation, and the yellow part of the ribbon is free from dust to thereby prevent the print quality from being deteriorated due to the dust. Thus, the present invention may ensure the best possible print quality and avoid waste of ribbons and paper.

It should be understood that the present invention is not limited to any particular embodiment disclosed herein. Many variations of the examples discussed above will still be within the scope and spirit of the invention, as defined by the following claims.

What is claimed is:

1. A method of controlling the operation of a ribbon motor for a color printing system, comprising the steps of:

rotating a ribbon forward to expose a useable portion of said ribbon for printing:

detecting when a print operation has stopped:

rotating said ribbon in reverse after said print operation has stopped and before another print operation begins so that said useable portion of said ribbon becomes unexposed; and counting the time that said printing system is in a standby mode after the printing operation.

2. A method according to claim 1, wherein if the time that the printing system is in said standby mode is larger than a specific amount, the ribbon is rotated in reverse by a predetermined amount.

3. A method according to claim 2, wherein said count of time is cleared when a subsequent printing operation starts.

4. A method of controlling the operation of a ribbon motor for a color printing system, comprising the steps of:

rotating a ribbon forward to expose a useable portion of said ribbon for printing:

detecting when a print operation has stopped:

rotating said ribbon in reverse after said print operation has stopped and before another print operation begins so that said useable portion of said ribbon becomes unexposed: and presetting a critical point in the printing system in order to compare a count of the time that the printing system is in a standby mode with said critical point.

5. A method according to claim 4, wherein if the time that the printing system is in said standby mode is larger than the critical point, the ribbon is rotated in reverse by a predetermined amount.

6. A method of controlling the operation of a ribbon motor for a color printing system, comprising the steps of:

rotating a ribbon forward to expose and align an unused portion of said ribbon with a print head for use in a printing operation;

monitoring the time in which said unused portion of said ribbon is exposed; and rotating said ribbon in reverse if said monitored time reaches a predetermined limit, in order to prevent the deterioration of print quality due to dust particulates on said ribbon.

7. A method according to claim 6, wherein if said monitored time reaches said predetermined limit, then said ribbon is rotated in reverse for a sufficient distance to unexpose said unused portion of said ribbon.

8. A method according to claim 6, wherein said monitoring step is stopped and said monitored time is cleared when said printing operation starts, and said monitoring step restarts at the end of said printing operation.

9. A method according to claim 7, wherein said ribbon comprises segments of various colors arranged in sequence along said ribbon and said sufficient distance corresponds to the length of one colors segment.

10. A method according to claim 6, wherein said forward rotation and said reverse rotation are performed by different motors.

11. A method according to claim 6, further comprising the step of stopping said monitoring step if a print operation is initiated so that said reverse-rotating step is not performed before said initiated print operation.

12. A method according to claim 6, wherein said predetermined limit is zero seconds.

13. A system for controlling the use of a ribbon in a color printing system to prevent the deterioration of print quality due to dust particulates on said ribbon, comprising:

rotating means for rotating a ribbon wheel to advance said ribbon forward to expose and align an unused portion of said ribbon with a print head for use in a printing operation, and for rotating a ribbon wheel to move said ribbon in reverse upon receipt of a reverse command; and monitoring means for monitoring the time in which said unused portion of said ribbon is exposed and outputting a reverse command to said rotating means based upon said monitored time.

14. The system according to claim 13, wherein if said monitored time reaches a predetermined limit, then said monitoring means outputs said reverse command and said rotating means rotates said ribbon in reverse for a sufficient distance to unexpose said unused portion of said ribbon.

15. The system according to claim 13, wherein said monitoring means clears said monitored time when a printing operation starts, and begins monitoring when a printing operation stops.

16. The system according to claim 13, wherein said ribbon comprises segments of various colors arranged in sequence along said ribbon and said sufficient distance is one color segment.

17. The system according to claim 13, wherein said rotation means comprises:

a forward rotation motor for advancing said ribbon; and a reverse rotation motor for reversing said ribbon.

18. The system according to claim 13, wherein said monitoring means stops monitoring said time if a print operation is initiated so that said reverse-rotating is not performed by said rotation means before said initiated print operation.

19. The system according to claim 13, wherein said rotation means comprises a single motor for both advancing and reversing said ribbon.

20. A method of reducing dust accumulation on a portion of an exposed surface of a printer ribbon, comprising:

monitoring the amount of time that a print operation has stopped; and causing said exposed portion of said printer ribbon to become unexposed after said amount of time exceeds a predetermined limit.

* * * * *